US005992130A

United States Patent [19]

Lardoux et al.

[11] Patent Number: 5,992,130

[45] Date of Patent: Nov. 30, 1999

[54] PACKAGING OF REACTIVE HOT-MELT ADHESIVES

[75] Inventors: Celine Lardoux, Senlis; Christian Laurichesse, Margny-les-Compiegne, both of France

[73] Assignee: ATO Findley S.A., France

[21] Appl. No.: 08/975,666

[22] Filed: Nov. 21, 1997

[30] Foreign Application Priority Data

Nov. 22, 1996 [FR] France ..... 96.14298

[51] Int. Cl.[6] ..... B65B 63/08; B65B 61/18

[52] U.S. Cl. ..... 53/412; 53/440; 53/471; 206/447

[58] Field of Search ..... 220/62.22, 62.2; 229/236, 240; 206/447, 460, 813; 53/401, 412, 440, 471, 485, 488, 133.8, 127, 420

[56] References Cited

U.S. PATENT DOCUMENTS

| | | | |
|---|---|---|---|
| 2,033,855 | 3/1936 | Sloan | 220/62.22 |
| 2,869,722 | 1/1959 | Marander et al. | 206/447 |
| 3,099,593 | 7/1963 | Syracuse | 206/447 |
| 3,109,576 | 11/1963 | Karl . | |
| 3,648,882 | 3/1972 | Shelton | 206/447 |
| 5,002,523 | 3/1991 | Cho . | |
| 5,137,206 | 8/1992 | Hale . | |

FOREIGN PATENT DOCUMENTS

| | | |
|---|---|---|
| 649718 | 4/1995 | European Pat. Off. . |
| 661221 | 7/1995 | European Pat. Off. . |
| 459564 | 11/1996 | European Pat. Off. . |
| 3641385 | 6/1988 | Germany . |
| 2107272 | 4/1983 | United Kingdom . |

*Primary Examiner*—Linda Johnson
*Attorney, Agent, or Firm*—Bell, Boyd & Lloyd

[57] ABSTRACT

The invention relates to a process for packaging reactive hot-melt adhesive, which consists of pouring the adhesive composition in the molten state directly into a container (1) coated with a material (2) which is abherent on its inner face and with a material (3) which is moistureproof on its outer face, the container being provided with at least one easy-opening start device; and in securing a moisture-proof lid (4) to the free face of the container. It also relates to the packaged adhesives.

17 Claims, 1 Drawing Sheet

PACKAGING OF REACTIVE HOT-MELT ADHESIVES

FIELD OF THE INVENTION

The present invention relates to a process for packaging hot-melt adhesive compositions which can be crosslinked by moisture and to the adhesive compositions thus obtained.

BACKGROUND OF THE INVENTION

Hot-melt adhesives are generally processed in the molten or liquid state and acquire their adhesive properties on cooling, while becoming solid.

Crosslinkable hot-melt adhesives, in particular those containing isocyanate groups, are widely employed for assembling various materials such as wood, plastic, paper or cardboard because of their mechanical strength and their great heat stability.

Such properties are essentially due to the fact that, after the adhesive bonding, the reactive groups in the adhesive crosslink by reacting with water.

The abovementioned compositions, which are described as reactive, must be preserved from any premature crosslinking, in order that they may retain good performance and good homogeneity at the time of the adhesive bonding.

To this end it has been proposed to package such reactive hot-melt adhesives in the following packagings:

The most widely used packaging consists of a simple container inside which a flexible barrier film is placed, in most cases in the form of a bag, it being possible for the said container optionally to comprise a lid provided with a waterproof seal.

In EP-A-661 221 it is proposed to pour the adhesive into a primary container made of rigid material, the latter being placed in a secondary container substantially identical with the first in size and shape. The free surface of the adhesive is coated with a flexible film which has a low permeability to water vapour and the whole is closed with a sealed lid.

In EP-A-469 564 and EP-A-649 718 it is proposed to package one or more portions of adhesive in an enclosure which is flexible and compatible during the melting, and to place the whole thus formed in a second packaging, for example an enclosure or a container.

However, the packagings just described have disadvantages.

The abovementioned first two packagings require the transfer of the adhesive into the applicator device, and this is generally carried out by means of a hot plate. With the first container there is a risk that the inner film may tear or that it may not be possible to recover all of the adhesive, because of the folds in the film which are formed at the time the container is being filled.

The last packaging mentioned, for its part, requires the use of a stage of forming and conditioning of the portion(s) of adhesive, and this is relatively more complex and costly than a simple dispensing in the molten state.

DESCRIPTION OF THE INVENTION

The present invention proposes a new process for packaging reactive hot-melt adhesive compositions, more particularly of strong adhesiveness and without substantial shrinkage, which makes it possible to obtain adhesives that can be employed directly in a melt kettle.

This process consists in:

pouring the adhesive composition in the molten state directly into a container coated internally with an abherent material and externally with a moistureproof material, the body of the said container being provided with at least one easy-opening start device, and securing a moistureproof lid to the free face of the container.

Figure 1:
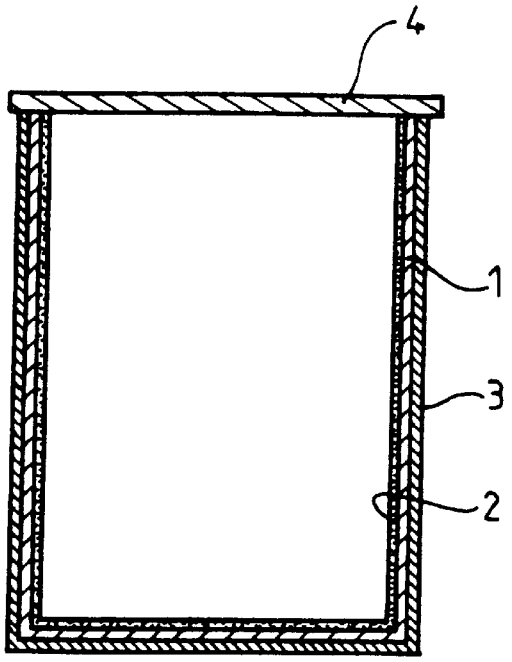
FIG. 1 shows a lengthwise section of the packaging employed in the process according to the invention: the packaging consists of a container (1) whose inner wall comprises an abherent coating (2) and whose outer wall consists of a moistureproof material (3), and of a lid (4), also moistureproof.

In the alternative form a, the wall forming the bottom (6) of the container and the lid (4) consist of a rigid metal plate crimped onto the body of the container.

In the alternative form b, only the lid (4) varies, which consists of an opening cover secured to the container and of a protective lid (7).

In the alternative forms a and b, the body of the container is provided internally with a start device **(8*a*) covered with a protection (9) and extended by a tab (8*b*)**.

The reactive hot-melt adhesive composition is chosen from compositions which can be crosslinked by moisture, preferably of strong adhesiveness and exhibiting substantially no contraction in volume after cooling (shrinkage). Examples which may be mentioned are compositions containing silanes or isocyanates which are free or in the form of a prepolymer. Illustrations which may be mentioned are diphenylmethane diisocyanate (MDI), tolylene diisocyanate (TDI), isophorone diisocyanate (IPDI), tetramethylxylene diisocyanate (TMXDI) and metavinylbenzene isocyanate (m-TMI).

The packaging consisting of the container (1) and of the inner (2) and outer (3) coatings generally has a volume which is compatible with easy storage and handling. This volume may, for example, be between 0.5 and 5 liters, and preferably 1 to 3 liters and, better still, of the order of two liters.

The packaging may be of any shape. However, it is generally chosen so that the adhesive obtained after the packaging has been removed has a shape that is compatible with the melt kettle of the application device. The packaging is preferably of a cylindrical shape.

The container (1) generally consists of a material which is sufficiently rigid to permit easy transport and handling.

Examples which may be mentioned are kraft cardboard or paper and polymers.

The container is advantageously obtained by spiral winding and adhesive bonding of kraft sheets.

The nature of the coating (2) can vary as a function of the adhesive aspect and of the reactivity of the adhesive. The coating generally consists of a material which does not adhere to the adhesive. Examples which may be mentioned are polymers based on silicones or on fluorine compounds such as polytetrafluoroethylene (PTFE), polychlorotrifluoroethylene (PCTFE), polyvinylidene fluoride (PVDF), perfluorinated poly(ethylene-propylene) (FEP) and ethylene-PTFE copolymers (ETFE). Silicones are preferably employed.

The coating (2) may be applied by starting with a resin or a varnish. It advantageously has a low permeability to water vapour.

The coating (3) is generally chosen from moistureproof materials, that is to say ones which are not substantially permeable to water. Examples which may be mentioned are metal, for example aluminium, polymers or any other material. Metal, and advantageously aluminium, is preferably employed.

The rigid or flexible lid (4) generally consists of a moistureproof material as described above. The lid is preferably made of metal.

When the lid is rigid, it is advantageously secured to the container by crimping.

When the lid is flexible, it is advantageously in the form of an opening cover which may be secured to the container by heat-sealing in the presence of a varnish. This assembly has advantageously added to it an additional lid put on top of the opening cover in order to protect it from any tearing during transport or storage. This lid may be made of metal, plastic or any other material, and preferably plastic.

The body of the container is provided with a start device intended to facilitate the opening of the packaging.

A "start device" is here intended to mean any means which makes it possible to make the container easy to break in one or more places in order to direct its opening.

Figure 2:
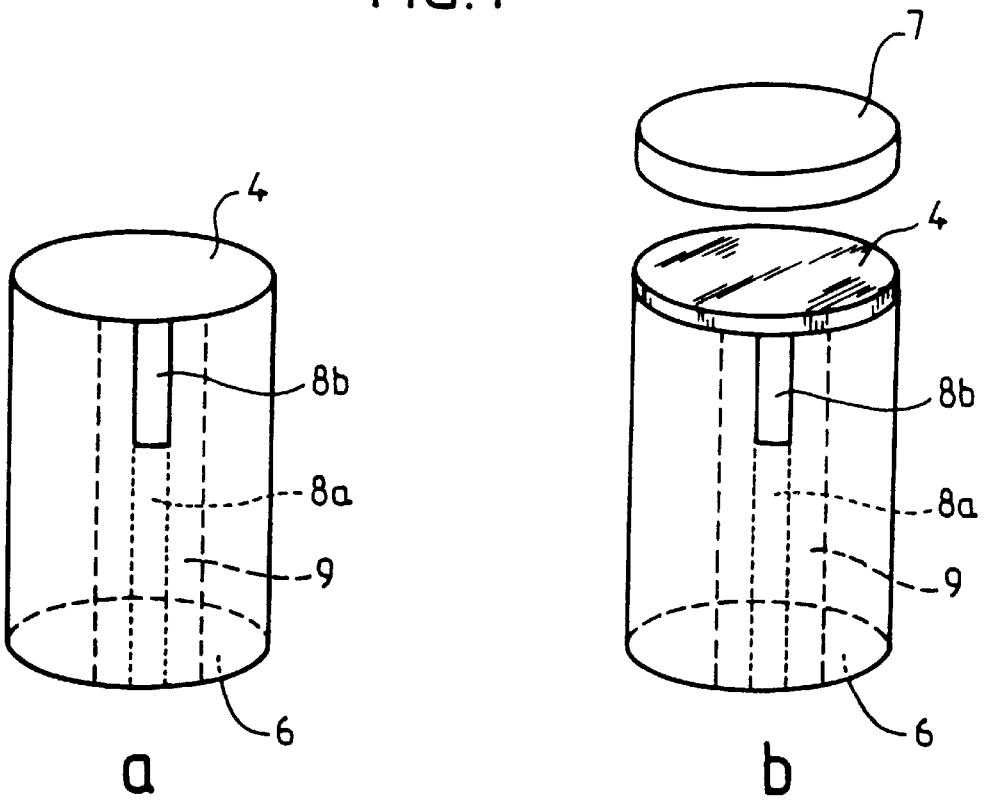
FIGS. 2 (*a*) and (*b*) shows a view of the whole packaging according to two preferred alternative forms.

Examples which may be employed are perforations or one or more tabs, especially as shown in FIG. 2. The tab (8*a*) placed inside the container is in contact with the coating (2) and can be secured equally well to the bottom (6) or to the lid (4). This tab has a free end (8*b*) for grasping.

Possible adhesive bonding of the adhesive to the tab (8*a*) is advantageously prevented by placing an abhesive protective device (9) in between.

The adhesive composition thus packaged can be easily released from its packaging at the time of use by handling the start device and may be placed in a melt kettle.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

We claim:

1. Process for packaging hot-melt adhesive compositions which can be crosslinked by moisture consisting of:

pouring the adhesive composition in the molten state directly into a container (1) coated internally with a coating of a material that does not adhere to the adhesive (2) and externally with a moistureproof material (3), a body of the said container being provided with at least one easy-opening start device, securing a moistureproof lid (4) to a free face of the container, and operating said easy-opening start device for exposing and releasing the adhesive from the container in solid form and for direct use in a melt kettle without need for heat to transfer the adhesive to the melt kettle.

2. Process according to claim 1, wherein the coating of a material that does not adhere to the adhesive is selected from polymers based on silicones or on fluorine compounds.

3. Process according to claim 1, wherein the moistureproof material (3) is selected from metals and polymers.

4. Process according to claim 1, wherein the adhesive composition contains silanes or isocyanates.

5. Process according to claim 4, wherein the adhesive does not exhibit any substantial shrinkage.

6. A container for packaging a reactive hot-melt adhesive composition which is crosslinked by exposure to moisture comprising:

an outer wall of a moistureproof material, an inner wall coating of a material that does not adhere to the adhesive, the container being rigid for transport and handling of the adhesive composition that is poured in a molten state through an opening directly into the container and into contact with the inner wall coating, a moistureproof lid for sealing the opening of the container, and means including at least one easy-opening start device for exposing and releasing the adhesive from the container in solid form and for direct use in a melt kettle without need for heat to transfer the adhesive to the melt kettle.

7. The container according to claim 6 wherein the container is cylindrical.

8. The container according to claim 6 wherein the container has a volume of between 0.5 and 5.0 liters.

9. The container according to claim 6 wherein the container has a volume of between 1.0 and 3.0 liters.

10. The container according to claim 6 wherein the inner wall coating is selected from polymers based on silicones or on fluorine compounds.

11. The container according to claim 6 wherein the inner wall coating is selected from the group consisting of polytetrafluoroethylene (PTFE), polychlorotrifluoroethylene, polyvinylidene fluoride, perfluorinated poly(ethylene-propylene) and ethylene-PTFE copolymer.

12. The container according to claim 6 wherein the moistureproof outer wall is formed of metal or polymer.

13. The container according to claim 6 wherein the moistureproof outer wall is formed of aluminum.

14. The container according to claim 6 wherein the adhesive composition contains silanes or isocyanates.

15. The container according to claim 6 wherein the adhesive composition is selected from the group consisting of diphenylmethane diisocyanate, tolyene diisocyanate, isophorone diisocyate, tetramethylxylene diisocyanate and metavinylbenzene isocyanate.

16. The container according to claim 6 wherein the easy-opening start device comprises at least one tab connected to the inner wall coating and having a graspable free end.

17. A process for packaging a reactive hot-melt adhesive composition which is crosslinked by exposure to moisture comprising:

pouring the adhesive composition in a molten state directly into a container through an opening thereof, the container being rigid for transport and handling, the container having (1) an outer wall of a moistureproof material, (2) an inner wall coating of a material that does not adhere to the adhesive and (3) at least one easy-opening start device, securing a moistureproof lid to seal the opening in the container, operating the at least one easy-opening start device to expose the adhesive in the container, and removing the adhesive from the container in solid form, and placing the solid adhesive directly in a melt kettle, without need for heat to transfer the adhesive to the melt kettle.

* * * * *